US005908237A

United States Patent [19]

Devir et al.

[11] Patent Number: 5,908,237

[45] Date of Patent: Jun. 1, 1999

[54] FLEXIBLE LAMP TUBE SUPPORT

[75] Inventors: Daniel D. Devir, South Sutton; Robert J. Schmitt, Jr., Raymond; Doreen R. Audette, Henniker, all of N.H.

[73] Assignee: Osram Sylvania Inc., Danvers, Mass.

[21] Appl. No.: 09/160,810

[22] Filed: Sep. 25, 1998

[51] Int. Cl.[6] ..... F21V 15/04

[52] U.S. Cl. ..... 362/390; 362/260

[58] Field of Search ..... 362/288, 260, 362/216, 369, 390

[56] References Cited

U.S. PATENT DOCUMENTS 5,797,675 8/1998 Tanner, Jr. ..... 362/396

*Primary Examiner*—Stephen Husar
*Attorney, Agent, or Firm*—William E. Meyer

[57] ABSTRACT

A flexible lamp tube support having lamp support end a coupling to hold a lamp tube on one end and a latching portion to couple into a through hole is disclosed. The flexible, soft body coupler is inexpensive, has low heat conduction, can securely hold the lamp and cushion the lamp. The simple construction is adaptable to differing lamp, housing, and through hole configurations.

14 Claims, 7 Drawing Sheets

FLEXIBLE LAMP TUBE SUPPORT

TECHNICAL FIELD

The invention relates to electric lamps and particularly to tubular electric lamps. More particularly the invention is concerned with a flexible support to hold tubular lamp in position.

BACKGROUND ART

Fluorescent lamps are typically straight tubes, with both ends mounted in brackets providing electrical connection. Recently, small fluorescent lamps have bee created with a diameter similar to that of a pencil. A similar, and equally small neon lamp has been created. These lamps can be curved to conform to a sculpted housing, wrapped around corners or formed to follow the interiors of cavities. This is particularly useful in automotive vehicles, where these lamps can be used in exterior and interior lighting. Accurate positioning of the lamps with respect to a reflector, particularly given the jarring motions lamps may receive in even normal automotive use can be problem. The lamps also expand and contract with heat, so any rigid coupling would have to accommodate changing dimensions. In one vehicle, one must accommodate expansion not only from the heat of the lamp in operation, but also the ambient heat, for example in desert; and then also accommodate cold contraction for example due to an Arctic night. It is a feature of fluorescent and other discharge lamps, like neon lamps, that a cold spot on the envelope surface can deflect the discharge, reduce the light output or otherwise change the function of the lamps. Lamp supports that act as heat sinks are then undesirable. Further, with expanding acceptance of discharge lamps in high production products, such as vehicles there is a need for a lamp coupling that on the one hand is inexpensive, both in initial cost and in assemble labor, and on the other hand is durable, accurate, and minimally interferes with lamp function. There is then a need for an inexpensive, highly functional support for tubular lamps.

DISCLOSURE OF THE INVENTION

A flexible support for a tubular lamp extended along an axis, may be formed with a lamp support portion to couple with and support a tubular lamp body, a through connector portion extending from the support portion, the through connector having a connector length and a connector cross sectional form sufficient to fit within, and extend through a passage defined by a wall formed in a lamp housing element. The support further includes a compressible latch portion extending from the through connector, the latch portion having at least one flexible portion sufficiently compressible to pass through the passage in a compressed state, and expandable to an extended state, and when in the extended state, having a greater cross section than the passage cross section to thereby inhibit withdrawal through the passage. A pull tab extends from the latch portion. The pull tab has a length and cross sectional form sufficient to extend from the interior side through and sufficiently beyond the exterior side of the passage to facilitate positioning of the flexible support in a latched position in the passage.

BEST MODE FOR CARRYING OUT THE INVENTION

Figure 1:
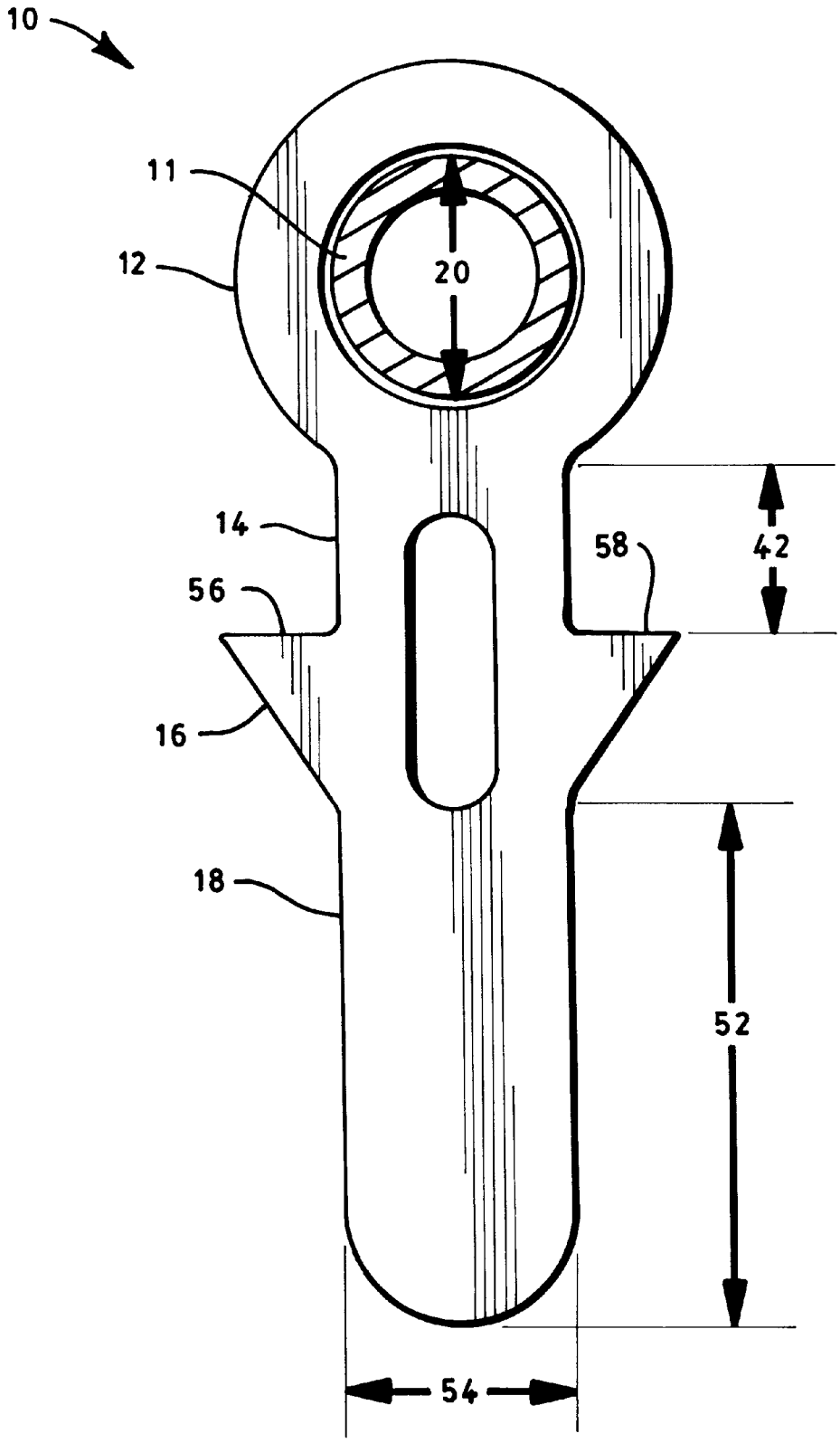
FIG. 1 shows a front view of a preferred embodiment of a flexible lamp tube support with the lamp tube in cross section.

FIG. 1 shows a front view of a preferred embodiment of a flexible lamp tube support 10 with a lamp tube 11 in cross section. Like reference numbers designate like or corresponding parts throughout the drawings and specification. The flexible lamp tube support 10 includes a lamp coupler 12 to support the lamp 11, a through connector 14, and a compressible latch portion 16, and a pull tab 18.

In the preferred embodiment the lamp support 10 is formed as a unitary body from a flexible, compressible and relatively heat insulating material such as a silicon rubber. In one embodiment, the lamp support 10 was cut from a flat sheet of silicon rubber. Nonetheless, the described structure may be formed as individually molded pieces with some of the sections being formed symmetrically in three dimensions. Further, while it is particularly convenient to form the structure as a single piece of silicon rubber, it should be understood that the functions of the various sections may be achieved with separate segments with separate materials, the various segments being joined to function as a unit.

The lamp tube being supported is understood to be tubular, with a straight circular cylindrical form being the simplest. Curved tubes, are specifically anticipated and the present design is particularly directed for use with curved or other irregular shaped tubes. Starting from the lamp coupling end the lamp support 10 then has the following subsections.

The first section is a lamp coupler 12 to hold and support a lamp 11. The preferred lamp coupler 12 is ring formed with a passage having an inside opening sized and shaped to admit the insertion of the lamp 11, for example as a round form with a diameter 20. The lamp 11 is then constrain by the surrounding ring. The use of silicon rubber for the lamp coupler 12 is preferred as it is both cushioning and provides relatively little heat conduction from the lamp.

Figure 2:
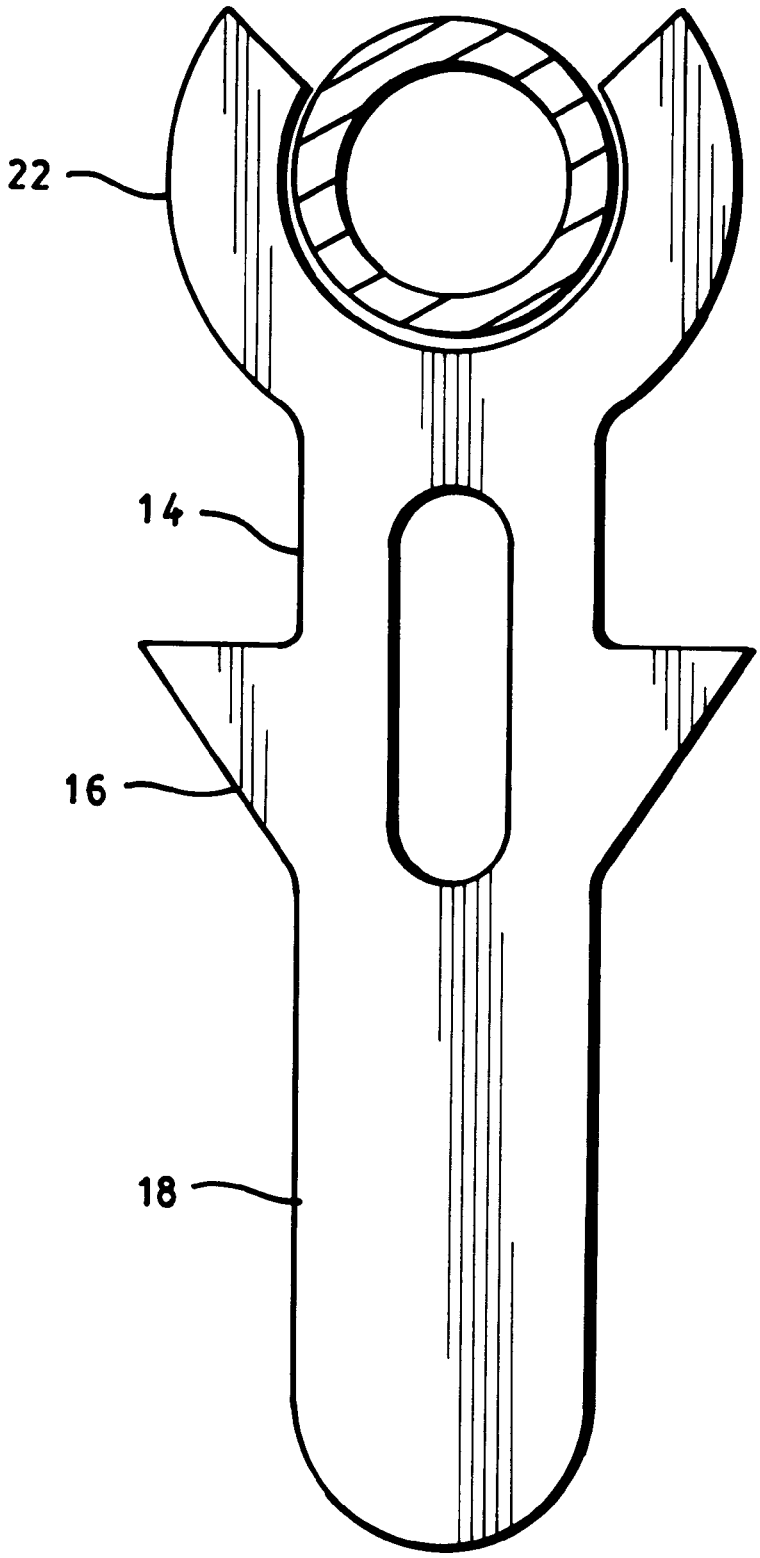
FIG. 2 shows a front view of an alternative embodiment of a lamp support with a clip on coupler.

FIG. 2 shows a front view of an alternative embodiment of a lamp support with a clip on coupler 22. As an alternative, a semicircular clip 22, or similar three point coupler that snaps on transverse to the lamp axis is likely functional. A stiffer material is needed to support the clip function. The convenience of the clip on feature, must be weighed against the possibility of equally simple failure of unclipping. The Applicants prefer a complete ring, that can be relatively more cushioning, and at the same time less prone to a possible dismounting failure.

Figure 3:
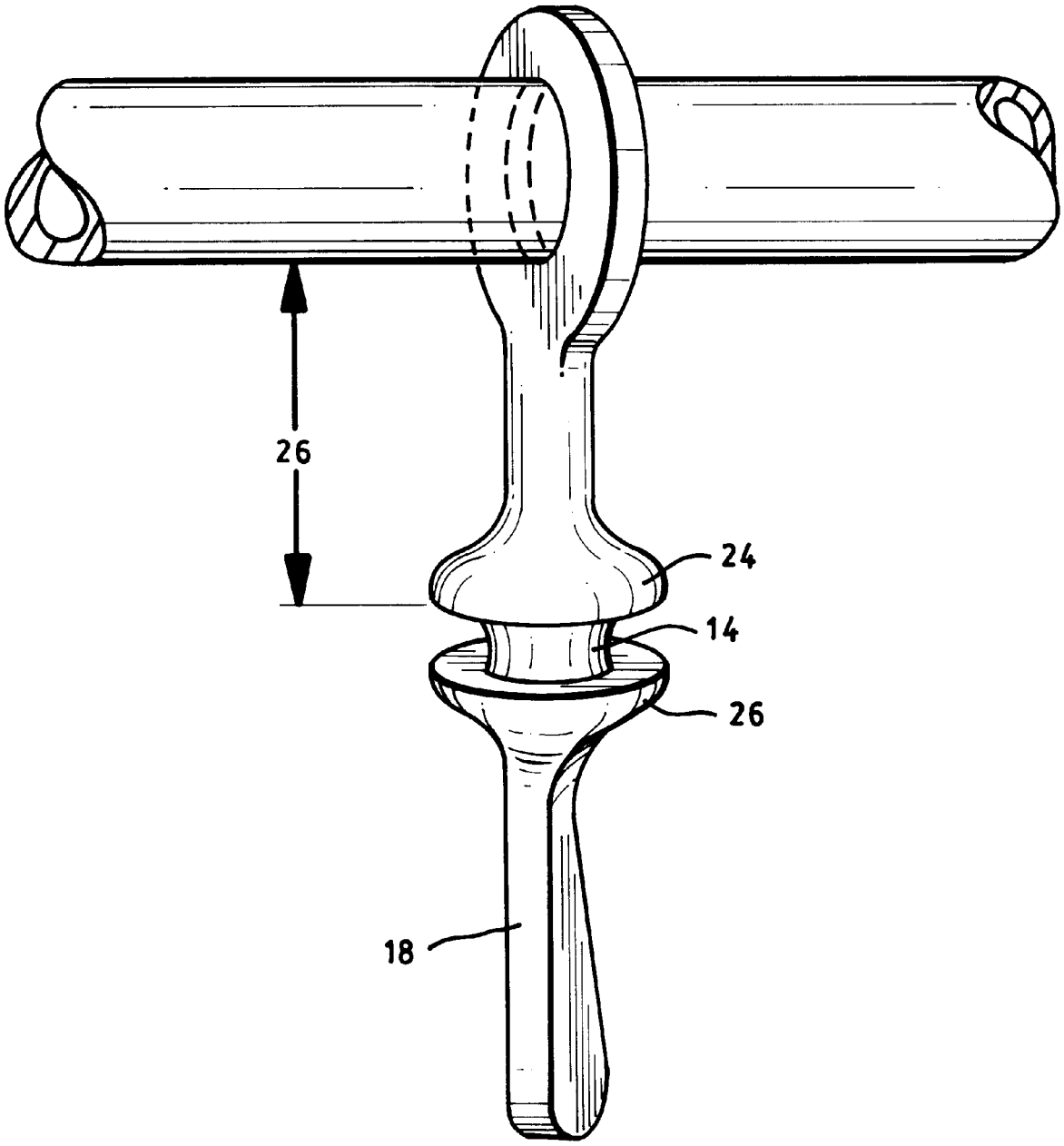
FIG. 3 shows a perspective view of an alternative embodiment of a flexible lamp tube support.

The lamp coupler 12 may also include a rib, circumferential edge, or other circumferential features for latching, grasping, coupling, holding, sealing, stopping or limiting passage of the lamp coupler 12 too far into the hole 30. In the preferred embodiment the lamp coupler 12 is immediately adjacent the through connector 14, and thereby acts to block further passage of the lamp coupler 12. FIG. 3 shows a perspective view of an alternative embodiment of a flexible lamp tube support. In the alternative design, positioned intermediate the lamp coupler 12 and the through connection 14 is a stop rib 24. The stop rib 24 may be positioned away from where the lamp is located by a displacement distance 26. The displacement distance 26 can be adjusted to provide a proper stand off distance between the final lamp position and the lamp housing 34. In the alternative design, an interior stop rib 24 and exterior stop rib 28 on either end of the through connector 14 are positioned to latch the lamp support 10 in place with respect to the lamp housing 34.

Figure 4:
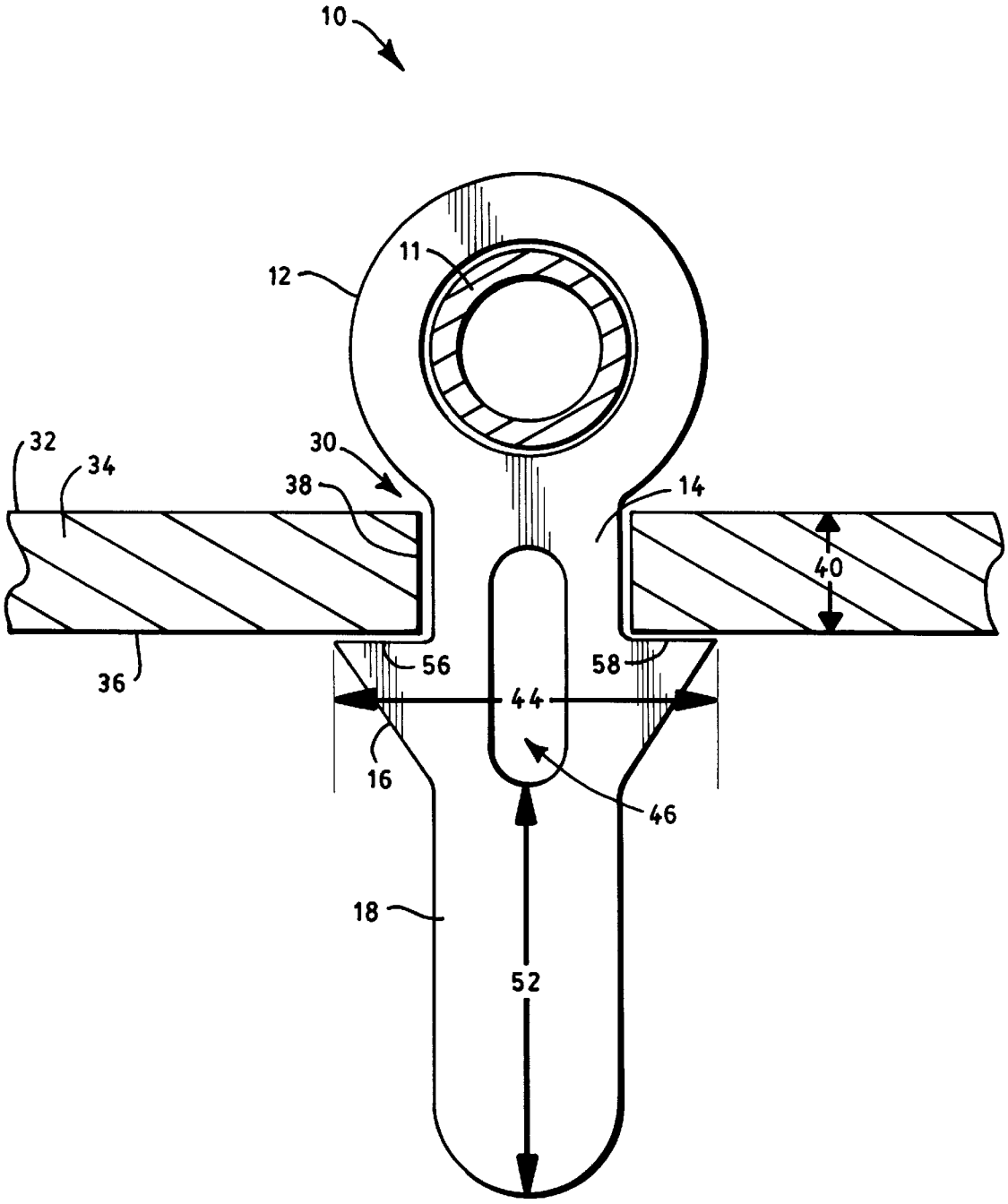
FIG. 4 shows a front view of a preferred embodiment of a flexible lamp tube support positioned in a lamp housing in cross section.

Coupled to the ring support is a through connector 14. The through connector 14 is designed to mate with a through hole 30 formed in a lamp housing 34. FIG. 4 shows a front view of a preferred embodiment of a flexible lamp tube support 10 positioned in a lamp housing 34 with a through hole 30 shown in cross section. The through hole 30 extends from an interior side 32 of the housing 34, the side facing the lamp, to an exterior side 36 of the housing 34, the side facing away from the lamp. The interior wall 38 of the through hole 30 defines a passage length 40 extending from the interior side 32 to the exterior side 36, and a passage cross sectional form. The preferred through connector 14 has a connector length 42 and a connector cross sectional form sufficient to fit within, and extend through the defined hole 30. The through connector 14 may have any convenient cross sectional form whether planar, triangular, square, polygonal or a circular. In one embodiment the through connector 14 has a smaller cross sectional form than does the hole 30, and the relatively thinner through connector 14 then extends easily in the defined hole 30. In another alternative embodiment, the through connector 14 is sized and shaped to compressibly conform with the wall 38. The relatively fatter through connector 14 then seals the defined hole 30. The through connector 14 may also have a slightly smaller length 42 than the length 40 of the hole 30, so that the through connector 14 must be stretched (tensioned) to gain the required slightly additional length. The tension in the through connector 14 can then act to seal one or both ends (lamp coupler 12, and latch portion 16) of the lamp support 10 to the exterior surfaces 32, 36 of the adjacent lamp housing 34.

Extending from the through connector 14, on the exterior side 36 of the lamp housing 34 is a compressible latch portion 16. The latch portion 16 has at least one flexible portion sufficiently compressible to pass through the hole 30 in a compressed state, and expandable to subsequently re-expand to an extended state. When in the extended state, the latch portion 16 has a greater cross sectional dimension 44 than does the cross section of the hole 30. The latch portion 16 then inhibits withdrawal of the lamp support 10 from the hole 30, and therefore from the lamp housing 34. In one embodiment the latch portion 16 is sized and shaped to circumferentially extend around the exterior side 36 of the wall 38 and compressibly conform with the exterior side 36 of the lamp housing 34. The extended latch portion 16 then seals with exterior side 36, and therefore seals the defined hole 30.

Figure 5:
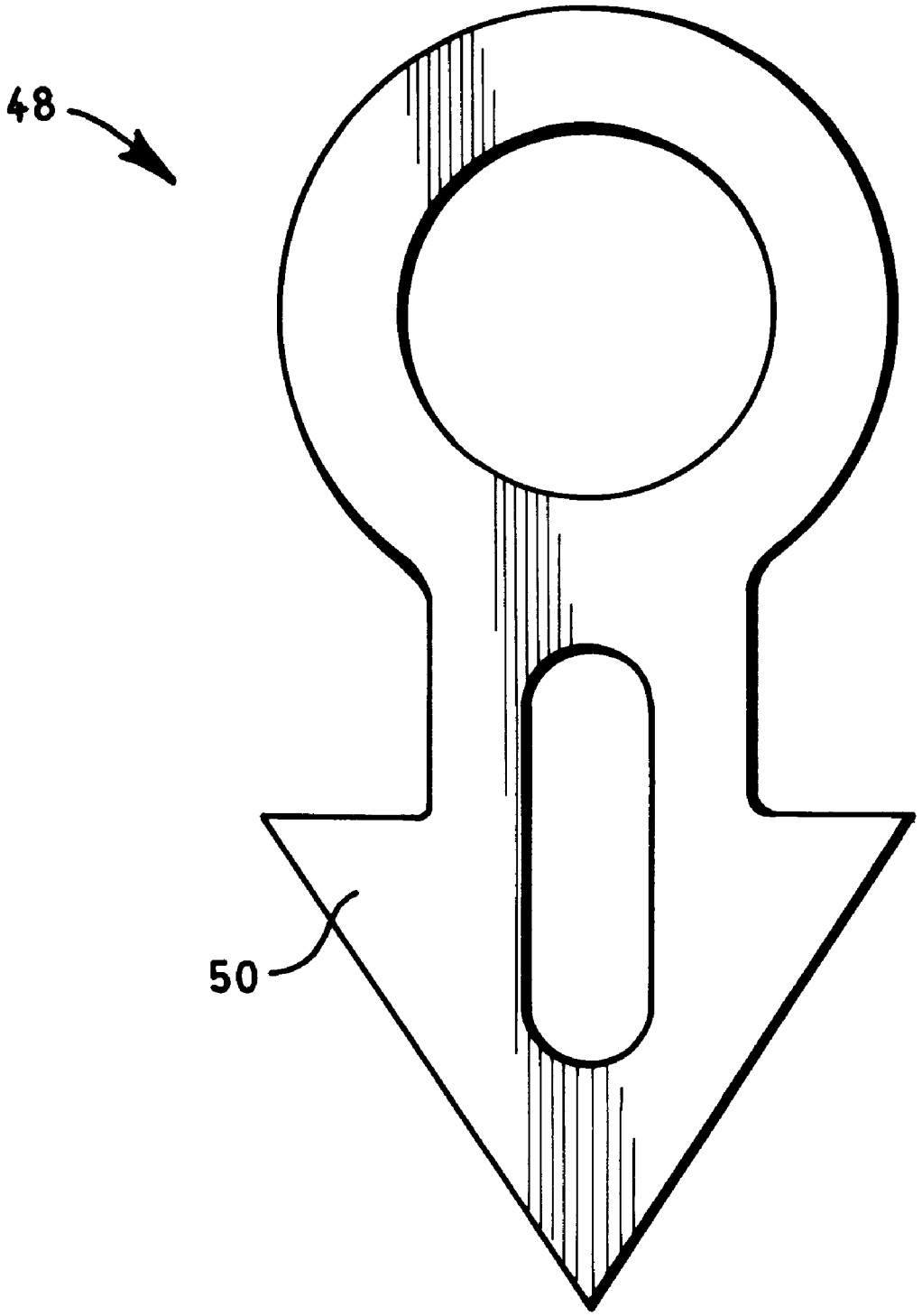
FIG. 5 shows a front view of an alternative embodiment of a flexible lamp tube support with no pull tab.

The through connector 14 or the latch portion 16 or both may be formed with a cavity 46 therein to facilitate compression when passing through the hole 30. The cavity may also extend between through connector 14 and the latch portions 16 of the lamp support 10. FIG. 5 shows a front view of an alternative lamp support 48 with no pull tab. The alternative lamp support 48 is then pressed into the hole 30, so that the latch portion 50 extends through and expands on exterior side 36.

Figure 6:
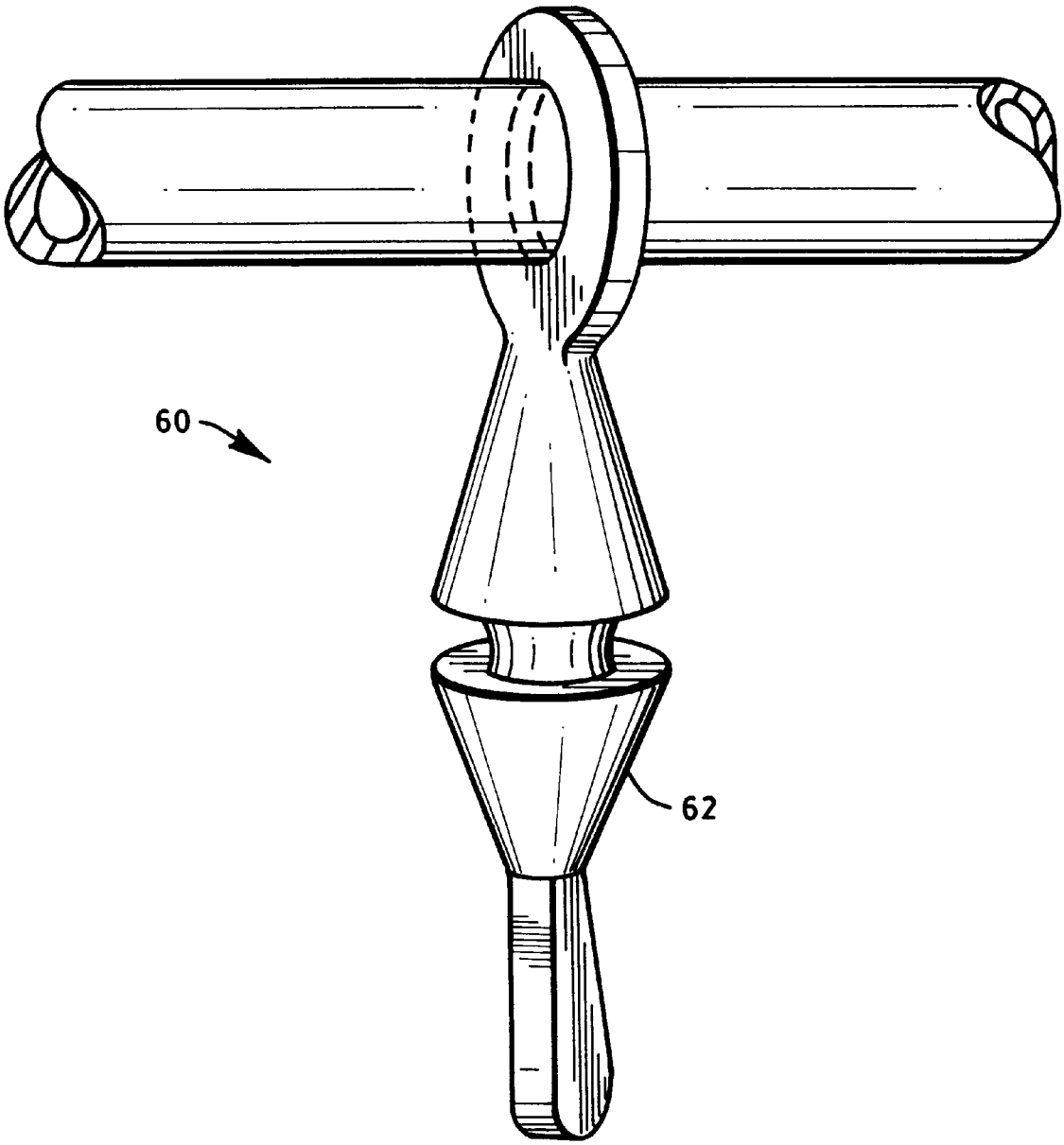
FIG. 6 shows a front view of an alternative embodiment of a flexible lamp tube support with a conical stop.
Figure 7:
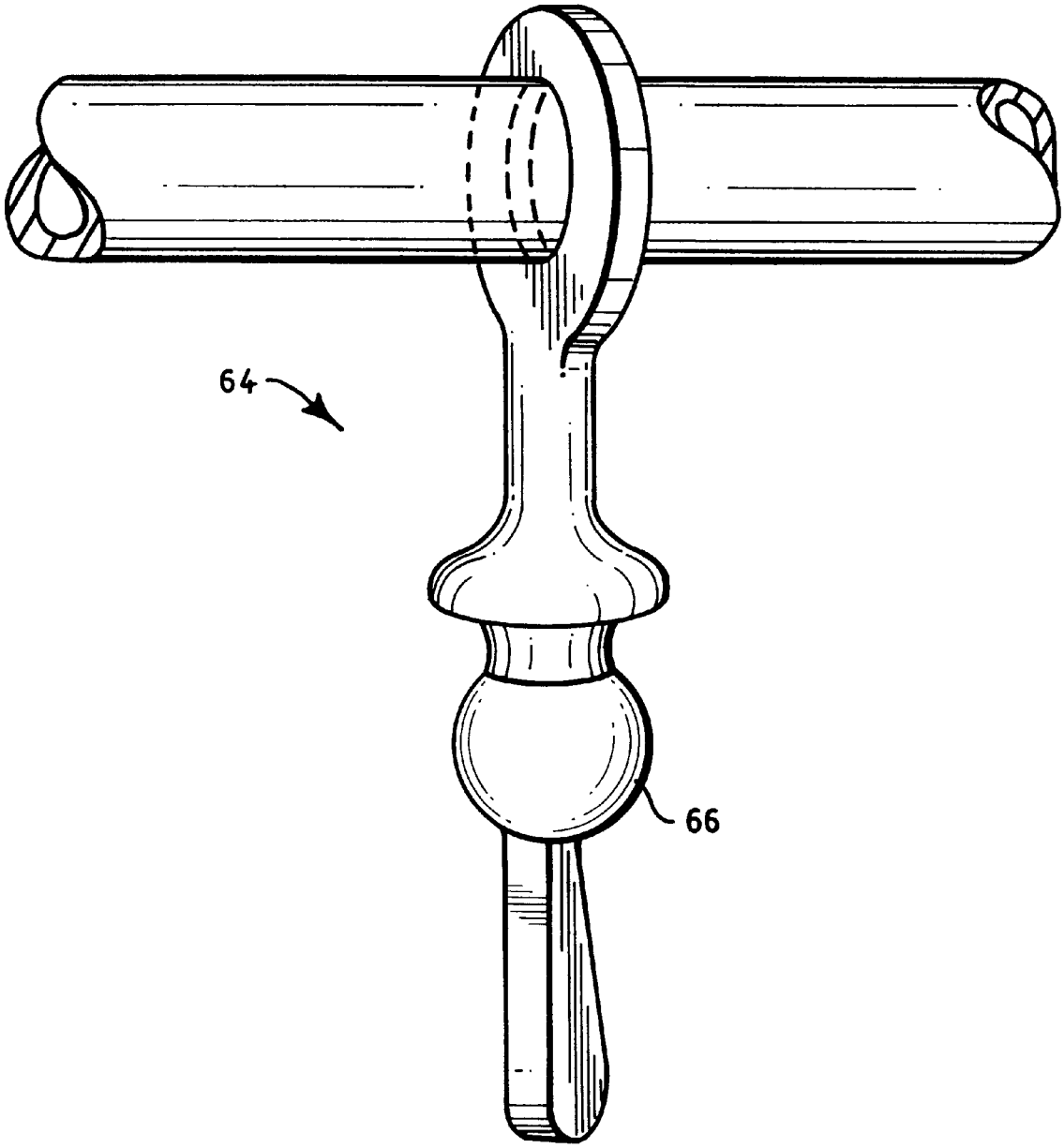
FIG. 7 shows a front view of an alternative embodiment of a flexible lamp tube support with a spherical stop.

In the preferred embodiment, FIG, 1, 4, extending from the latch portion 16 is a pull tab 18. The pull tab 18 has a length 52 and cross sectional dimension 54 sufficient to be threaded from the interior side 32 through and sufficiently beyond the exterior side 36 of the hole 30 to facilitate positioning of the flexible lamp support 10 in a latched position. With the pull tab 18 extended through the hole 30, a tip end of the pull tab 18 may be grasped on the exterior side 36 of the hole 30. The latch portion 16 may them be pulled through to secure the latching. The formed stops 56, 58 along the latch portion 16 to limit the lamp support 10 from being pull back through the hole 30. The lamp is then well centered in directions transverse to the axis of the lamp support 10. This assures good optical positioning in a reflector (e.g. lamp housing 32) despite jarring of the whole structure. The lamp 11 is relatively free to move axially, for example for thermal expansion and contraction. Adjustments in actual forms and dimensions are possible. FIG. 6 shows a front view of an alternative embodiment of a flexible lamp tube support 60 with a conical stop 62. FIG. 7 shows a front view of an alternative embodiment of a flexible lamp tube support 64 with a spherical stop 665.

In a working example some of the dimensions were approximately as follows: The lamp support was cut from a sheet of silicon rubber. The sheet was approximately about 1.5 millimeters thick. Formed on one end was a ring with an outside diameter of about 8.0 millimeters and inside diameter of about 4.57 millimeters which was sufficient to receive and support a 5.0 millimeters outside diameter neon lamp. Extending from the ring was straight section about 3.05 millimeters long and 3.81 millimeters wide that served as the through connector. The compressible latch portion was next in series, having the form of wedge shaped arms extending 7.62 across both arms. The wedge extended about 3.05 millimeters axially to a pull tab portion with a length of about 9.0 millimeters and a width of 3.81 millimeters. Formed between the ring and the pull tab, in the middle of the through connector and the latch portion was an interior cavity about 5.08 millimeters long and 1.52 millimeters wide that enhanced the passage of the through connector and latch portion through the housing passage. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed:

1. A flexible support for a tubular lamp extended along an axis, comprising:

a lamp support to couple with and support a tubular lamp body, a through connector extending from the lamp support, the through connector having a connector length and a connector cross sectional form sufficient to fit within, and extend through a passage defined by a wall formed in a lamp housing element, the wall having an interior side and an exterior side and a defining a passage length and further defining a passage cross sectional form therebetween;

a compressible latch portion extending from the through connector, the latch portion having at least one flexible portion sufficiently compressible to pass through the passage in a compressed state, and expandable to an extended state, and when in the extended state, having a greater cross section than the passage cross section to thereby inhibit withdrawal through the passage, and a pull tab extending from the latch portion, the pull tab having a length and cross sectional form sufficient to extend from the interior side through and sufficiently beyond the exterior side of the passage to facilitate positioning of the flexible support in a latched position in the passage.

2. The support in claim 1, where in the latch portion is formed from flexible a silicon rubber material.

3. The support in claim 1, where in the lamp support comprises a ring formed with a passage having a diameter sufficient to admit the insertion of the tubular lamp and thereby constrain the lamp therein.

4. The support in claim 1, wherein the through connector is sized and shaped to compressibly conform with the wall and thereby seal the defined passage.

5. The support in claim 1, wherein the latch portion is sized and shaped to circumferentially extend around the exterior side of the wall and compressibly conform with the housing and thereby seal the defined passage.

6. The support in claim 3, wherein the through connector length when positioned in the passage is extended under tension, thereby tensioning the latch portion against the housing.

7. The support in claim 3, wherein the through connector includes a formed cavity to facilitate compression when passing through the passage.

8. The support in claim 3, wherein the latch portion includes a formed cavity to facilitate compression when being passed through the passage.

9. The support in claim 3, wherein the through connector and latch portion include a formed cavity therein to facilitate compression when passing through the passage.

10. A flexible support for a tubular lamp extended along an axis, comprising:

a flexible unitary body formed from a silicon rubber material having in sequence;

a lamp support to couple with a tubular lamp along the lamp body, a through connector extending from the lamp coupler, the through connector having a connector length and a connector cross sectional form sufficient to fit within, and extend through a passage defined by a wall formed in a lamp housing element, the wall having an interior side and an exterior side and a defining a passage length and defining a passage cross sectional form therebetween;

a compressible latch portion extending from the through connector, the latch having at least one flexible portion sufficiently compressible to pass through the passage in a compressed state, and expandable to an extended state, and when in the extended state, having a greater cross section than the passage cross section to thereby inhibit withdrawal through the passage.

11. The support in claim 10, wherein the latch portion includes two arms located diametrically opposed to each other and perpendicular to the axis.

12. The support in claim 10, wherein the latch portion is a flexible conical section with a major diameter greater than the passage diameter.

13. The support in claim 10, wherein the latch portion is a flexible ball section with a major diameter greater than the passage diameter.

14. A flexible support for a tubular lamp extended along an axis, comprising:

a flexible unitary body formed from a silicon rubber material having in sequence:

a lamp coupler formed with a passage having a diameter sufficient to admit the insertion of the tubular lamp and thereby be constrain the lamp therein, a through connector extending from the lamp coupler, the through connector having a connector length and a connector cross sectional form sufficient to fit within, and extend through a passage defined by a wall formed in a lamp housing element, the wall having an interior side and an exterior side and a defining a passage length and defining a passage cross sectional form therebetween; the through connector being sized and shaped to compressibly conform with the wall and thereby seal the defined passage; through connector length when positioned in the passage is extended under tension, thereby tensioning the latch portion against the housing a compressible latch portion extending from the through connector, the latch having at least one flexible portion sufficiently compressible to pass through the passage in a compressed state, and expandable to an extended state, and when in the extended state, having a greater cross section than the passage cross section to thereby inhibit withdrawal through the passage, the latch portion being sized and shaped to circumferentially extend around the exterior side of the wall and compressibly conform with the housing and thereby seal the defined passage; the through connector and latch portion include a formed cavity therein to facilitate compression when positioned in the passage; and a pull tab extending from the latch portion, the pull tab having a length and cross sectional form sufficient to extend from the interior side through and sufficiently beyond the exterior side of the passage to facilitate positioning of the flexible support in a latched position in the passage.

* * * * *